US011788340B2

(12) United States Patent
Walz et al.

(10) Patent No.: US 11,788,340 B2
(45) Date of Patent: Oct. 17, 2023

(54) DOMESTIC ELECTRICAL APPLIANCE

(71) Applicant: emz-Hanauer GmbH & Co. KGaA, Nabburg (DE)

(72) Inventors: Dominik Walz, Nabburg (DE); Shaojiang Ren, Nanjing (CN); Georg Spiessl, Altendorf (DE); Albert Dirnberger, Neunburg vorm Wald (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 231 days.

(21) Appl. No.: 17/246,838

(22) Filed: May 3, 2021

(65) Prior Publication Data

US 2021/0348434 A1 Nov. 11, 2021

Related U.S. Application Data

(60) Provisional application No. 63/021,695, filed on May 8, 2020.

(30) Foreign Application Priority Data

May 14, 2020 (DE) ..... 102020113130.5
Apr. 8, 2021 (DE) ..... 102021108809.7

(51) Int. Cl.
*E05F 15/616* (2015.01)
*A47L 15/42* (2006.01)
(Continued)

(52) U.S. Cl.
CPC ..... *E05F 15/616* (2015.01); *A47L 15/4259* (2013.01); *D06F 39/14* (2013.01);
(Continued)

(58) Field of Classification Search
CPC ..... E05B 47/00; E05B 47/06; E05B 47/0603; E05B 2047/0067; E05B 2047/0068;
(Continued)

(56) References Cited

U.S. PATENT DOCUMENTS

2006/0283482 A1* 12/2006 Berends ..... A47L 15/0049 134/25.2
2011/0279004 A1 11/2011 Assmann et al.
(Continued)

FOREIGN PATENT DOCUMENTS

CN 102641105 A 8/2012
CN 103874796 A 6/2014
(Continued)

*Primary Examiner* — Nathan Cumar
(74) *Attorney, Agent, or Firm* — Hayes Soloway PC

(57) ABSTRACT

A domestic electrical appliance includes an appliance main body having an access opening to a usable chamber formed inside the appliance main body, and a door which is movably mounted on the appliance main body and which in an open position frees the access opening and in a closed position closes the access opening, a door latch for holding the door closed in the closed position, and a door opener, structurally separate from the door latch, for opening the closed door. The door opener includes a first coupling structure displaceably arranged on one of the appliance main body and the door, an electrically controllable drive unit for driving the first coupling structure, and a second coupling structure arranged on the other of the appliance main body and the door. The first and second coupling structure are configured for push- and pull-transmitting but releasable coupling engagement with one another.

15 Claims, 9 Drawing Sheets

Figure 1:
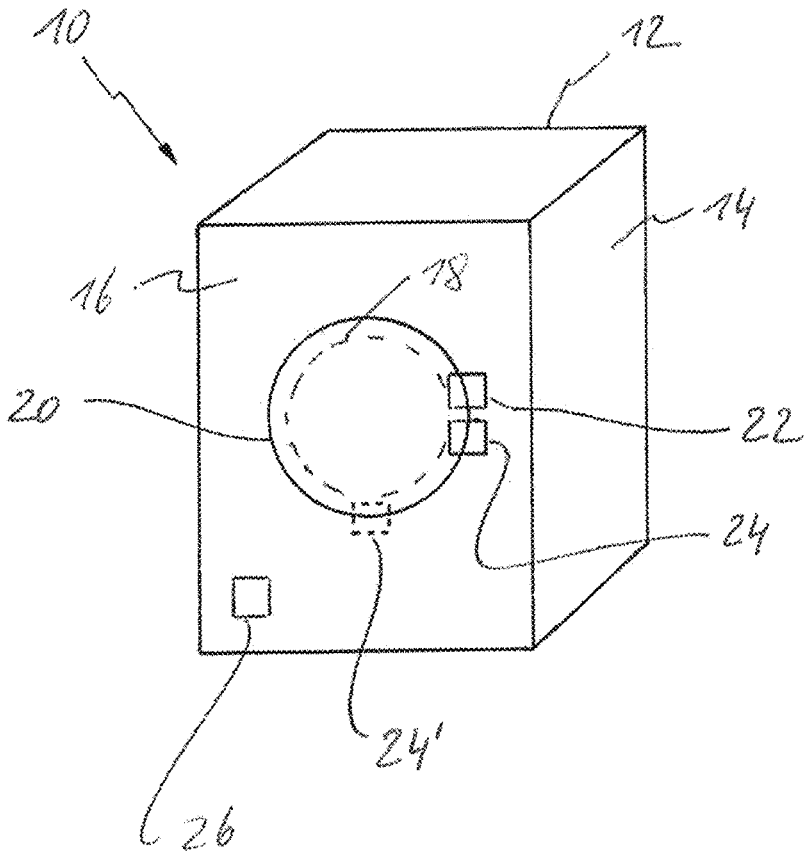

(51) Int. Cl.
*E05B 47/06* (2006.01)
*D06F 39/14* (2006.01)
*E05B 47/00* (2006.01)

(52) U.S. Cl.
CPC .. *E05B 47/0603* (2013.01); *E05B 2047/0068* (2013.01); *E05Y 2900/30* (2013.01)

(58) Field of Classification Search
CPC ..... E05B 2047/0069; E05Y 2900/00; E05Y 2900/30; E05Y 2900/304; E05Y 2900/312; E05F 15/00; E05F 15/60; E05F 15/611; E05F 15/614; E05F 15/616; E05F 15/619; A47L 15/4259; A47L 15/4261
USPC ..... 292/144
See application file for complete search history.

(56) References Cited

U.S. PATENT DOCUMENTS

| | | | |
|---|---|---|---|
| 2016/0348919 | A1 | 12/2016 | Branko et al. |
| 2017/0051535 | A1 | 2/2017 | Olson |
| 2019/0301230 | A1 | 10/2019 | Spiessl et al. |

FOREIGN PATENT DOCUMENTS

| | | | | | |
|---|---|---|---|---|---|
| CN | 105874116 | A | | 8/2016 | |
| CN | 106197603 | A | | 12/2016 | |
| CN | 106255790 | A | | 12/2016 | |
| CN | 106498670 | A | | 3/2017 | |
| CN | 110049707 | A | | 7/2019 | |
| CN | 110318226 | A | | 10/2019 | |
| CN | 111021837 | A | | 4/2020 | |
| DE | 19837248 | A1 | | 2/2000 | |
| DE | 102006029202 | A1 | | 12/2007 | |
| DE | 202017103995 | U1 | | 11/2018 | |
| EP | 1733675 | A2 | | 12/2006 | |
| EP | 2210547 | A1 | | 7/2010 | |
| EP | 2193740 | B1 | * | 4/2012 | ..... A47L 15/4259 |
| EP | 2436864 | A1 | * | 4/2012 | ..... A47L 15/4259 |
| EP | 3645781 | A1 | | 5/2020 | |
| KR | 20160148624 | A | | 12/2016 | |
| WO | WO-2011003714 | A1 | * | 1/2011 | ..... A47L 15/4259 |
| WO | 2013054279 | A1 | | 4/2013 | |
| WO | 2015071157 | A1 | | 5/2015 | |
| WO | 2015167716 | A1 | | 11/2015 | |
| WO | 2019003125 | A1 | | 1/2019 | |

* cited by examiner

DOMESTIC ELECTRICAL APPLIANCE

The invention relates to a domestic electrical appliance which is equipped with a door for closing an access opening to a usable chamber of the domestic appliance. In particular, the invention relates to a domestic electrical appliance which is equipped with a door opener for opening the door without intervention by the user, for example after an operating program of the domestic appliance has been run.

Many domestic electrical appliances such as, for example, washing machines, dishwashers, tumble dryers, microwave ovens, baking ovens and the like have a door which can be held in a closed position by means of a door latch. In the closed position of the door, an access opening to a usable chamber of the domestic appliance is closed. In the case of a washing machine and in the case of a tumble dryer, the usable chamber is the laundry chamber into which the laundry to be cleaned or dried is introduced, in the case of a dishwasher it is the dishwashing chamber into which the dishes to be cleaned are placed, and in the case an oven (microwave oven, baking oven) it is the cooking chamber into which the item to be heated or cooked is placed. At the end of a program run of an operating program, it can be desirable, at least in the case of some of these types of domestic electrical appliance, to automatically open the door at least slightly in order that, for example in the case of a washing machine, a tumble dryer or a dishwasher, moisture or hot steam can be discharged more quickly from the appliance. In the prior art, various mechanisms for automatic door opening have been proposed in this respect. In WO 2015/071157 A1, a pusher is advanced, which pusher pushes against the door with sufficient force to overcome the holding-closed force of a door latch. A mechanism disclosed in EP 2 210 547 A1 works in a similar manner. EP 1 733 675 A2 and WO 2011/003714 A1 additionally disclose mechanisms which are adapted specifically for dishwashers, in which a closing stirrup serving as part of a conventional door latch is able to be moved forwards and backwards by means of a suitable drive so that the door can be opened slightly while the door latch is closed. The force-based connection via the door latch thereby persists.

It is a problem underlying the invention to provide a domestic electrical appliance having an automatic door-opening function, wherein the mechanism that is responsible for the door-opening function is also to satisfy the requirements of automatically closing the door again even after a force-based connection achieved via a door latch has been separated.

In order to solve this problem the invention provides according to a first aspect a domestic electrical appliance which comprises: an appliance main body having an access opening to a usable chamber formed inside the appliance main body; a door which is movably mounted on the appliance main body and which in an open position frees the access opening and in a closed position closes the access opening; a door latch for holding the door closed in the closed position; and a door opener for opening the closed door. The door opener has a first coupling structure and a second coupling structure. The first coupling structure is displaceably arranged on one of the appliance main body and the door, wherein there is associated with the first coupling structure an electrically controllable drive unit for driving the first coupling structure. The second coupling structure is arranged on the other of the appliance main body and the door. The two coupling structures are configured to enter into push- and pull-transmitting but releasable coupling engagement with one another.

In the solution according to the invention, the door opener is a mechanism that is provided in addition to the door latch and formed by separate components (that is to say separate from the components of the door latch which, when the door is closed, are in mutual closing engagement in order to hold the door closed). In some embodiments, the door opener is in the form of an assembly which is structurally separate from the door latch, so that the door opener and the door latch are able to be fitted into the domestic appliance and optionally removed again independently of one another. It is, however, possible within the scope of the present disclosure to integrate mechanical or/and electromechanical components of the door opener and of the door latch in a common structural unit, which as such can be mounted on the door or the appliance main body. In the case of such structural integration too, the door latch and the door opener continue to establish separate force transmission paths for the transmission of a holding-closed force of the door latch and an opening force of the door opener between the door and the appliance main body of the domestic appliance. The door latch can be of conventional type and, on closing of the door, establish a force-based connection which holds the door in its closed position. The door latch can be, for example, a so-called pull latch or push-pull latch in which, by closing the door (the user pushes the open door in the direction towards its closed position), the door latch can be brought into a closed state and, starting from this closed state, the door can be opened and the door latch transferred from its closed state into an open state simply by pulling on the door (i.e. pulling the door open).

The door opener allows a force-based connection between the door and the appliance main body to be established while circumventing the door latch, as it were, that is to say while bypassing the force transmission path between the door and the appliance main body defined by the door latch for the transmission of the holding-closed force. To this end, the first coupling structure and the second coupling structure are configured in such a manner that they are able to be brought into a coupling engagement which allows the transmission both of pushing forces and of pulling forces between the first coupling structure and the second coupling structure. This allows the door to be moved in a controlled manner in both directions, that is to say in the closing direction and in the opening direction, when the coupling engagement is present by corresponding actuation of the drive unit. In particular, the push- and pull-transmitting coupling engagement allows the door, after it has been opened slightly for the purpose of ventilating the usable chamber, for example, to be closed again. Accordingly, it is provided in some embodiments that the door opener, starting from a first opener state in which the door is in the closed position and the first coupling structure is in coupling engagement with the second coupling structure, is able to be transferred, by driving of the first coupling structure, into a second opener state in which the door is slightly open and the coupling engagement between the first and the second coupling structure is maintained, and that the door opener, after being transferred into the second opener state, is able to be transferred back into the first opener state by driving of the first coupling structure again and while maintaining the coupling engagement between the first and second coupling structure.

The displaceability of the first coupling structure is, for example, a linear displaceability, in which the first coupling structure can be moved linearly to and fro between a relatively retracted position and a relatively advanced position. In the first opener state, the first coupling structure can be in its relatively retracted position. The first coupling structure can then occupy the relatively advanced position when the door opener is in its second opener state. At least in the relatively advanced position, the first coupling structure can protrude from the appliance component on which the first coupling structure is arranged (appliance main body or door). In some embodiments it can be provided that the first coupling structure protrudes from the appliance component in question also in the relatively retracted position. However, it can be provided as an alternative that the first coupling structure, at least in the relatively retracted position, is fully recessed in the appliance component in question and does not protrude therefrom. It will be appreciated that, instead of linear displaceability of the first coupling structure, another movement pattern is in principle also conceivable, for example pivotability.

In some embodiments, the coupling engagement between the first and second coupling structures is able to be released in the second opener state by the user pulling on the door. In such embodiments, it can additionally be provided that the coupling engagement between the first and second coupling structures is also able to be released in the first opener state by the user pulling on the door.

It can be that, in the second opener state, a user attempts to open the door fully by hand. To this end, he must release the coupling engagement between the two coupling structures, for example by pulling on the door with sufficient force. After the door has been opened fully, it can be expedient to move the first coupling structure back into a position that it occupies in the first opener state. This can be expedient in particular when, in the second opener state, the first coupling structure protrudes from the appliance main body or from the door (depending on which appliance component the first coupling structure is arranged), but in the first opener state the first coupling structure is sufficiently retracted into the appliance component in question that it does not present any risk of injury for the user and also is not itself at risk of being damaged by any knocks on the part of the user. Some embodiments therefore provide a sensor system for detecting separation of the coupling engagement in the second opener state, wherein the drive unit is controlled in such a manner that, in dependence on the detection of a separation of the coupling engagement in the second opener state, the first coupling structure is moved back in the direction towards a position that the first coupling structure occupies in the first opener state.

In some embodiments, a transfer, effected by driving of the first coupling structure, of the door opener from the first into the second opener state separates a force-based connection between the appliance main body and the door via the door latch, and a return movement, effected by driving of the first coupling structure, of the door opener from the second into the first opener state, while maintaining the coupling engagement between the first and the second coupling structure, re-establishes the force-based connection between the appliance main body and the door via the door latch.

According to some embodiments, the first and the second coupling structures are able to be brought into push- and pull-transmitting coupling engagement solely by being moved towards one another, and the coupling engagement is able to be released solely by moving the first and second coupling structures away from one another.

In some embodiments, the first and the second coupling structures are able to be brought into push- and pull-transmitting coupling engagement by being moved towards one another and overcoming a coupling resistance based on spring action. By moving the first and second coupling structures away from one another and overcoming a coupling holding force based on spring action, the coupling engagement is able to be released again in these embodiments.

In some embodiments, one of the first and second coupling structures forms a coupling head, while the other of the first and second coupling structures forms two coupling arms which are able to be resiliently deflected away from one another out of a rest position. The coupling engagement can thereby be established by relative introduction of the coupling head between the coupling arms.

A structurally simple form of the second coupling structure can be obtained in that the coupling arms are formed by the clasp legs of a spring clasp formed in one piece.

The transmission of pushing or/and pulling forces between the two coupling structures is ensured in some embodiments by interlocking or/and frictional coupling of the two coupling structures. For example, for the transmission of pushing forces, the coupling engagement can comprise a simple mechanical (i.e. physical) stop coupling between the two coupling structures. In some embodiments, the coupling engagement comprises, alternatively or in addition to interlocking or/and frictional coupling, a magnetic force-based connection between the first and the second coupling structures in the state of coupling engagement. The magnetic force-based connection can serve in particular to ensure the transmissibility of pulling forces between the two coupling structures. The magnetic force-based connection can thereby be sufficiently strong to overcome a resistance which is exerted by a door seal of the domestic appliance or/and by the door latch and which must be overcome in order to close the door fully, that is to say transfer it into the closed position.

In embodiments with magnetic force-based connection between the first and the second coupling structure, it is possible, for example, for one of the two coupling structures to be formed with a permanent magnet and the other of the two coupling structures to be formed with a metallic counter piece which can be attracted by the permanent magnet. The metallic counter piece can be, for example, an iron body or a body of another ferromagnetic material.

In order to protect the drive unit and a gear assembly optionally provided between the drive unit and the first coupling structure from mechanical impacts, it is provided in some embodiments that the second coupling structure is resiliently mounted on the other of the appliance main body and the door. A slip clutch between the first coupling structure and the drive unit can be dispensed with in this case.

In some embodiments in which the door is mounted on the appliance main body so as to be pivotable about a pivot axis, the first or/and the second coupling structure provide articulation and/or bending flexibility in a pivot plane orthogonal to the pivot axis. Owing to the pivotability of the door, the coupling structure arranged on the door moves along a circular arc when the door is moved. The relative orientation of the two coupling structures with respect to one another can accordingly change when the door is moved. This can be counteracted at least in part by articulation or bending flexibility of at least one of the two coupling structures. The quality of the coupling engagement can thus be maintained regardless of the pivot position of the door.

In some embodiments, the first coupling structure is arranged together with the drive unit on the appliance main body, while the second coupling structure is arranged on the door. It will be appreciated that, in other embodiments, a reversed arrangement is conceivable, according to which the first coupling structure and the drive unit are arranged on the door and the second coupling structure is arranged on the appliance main body.

In some embodiments, the drive unit is an electric motor, in particular an electric motor which is able to be driven in opposite directions of rotation. The electric motor can be combined with the first coupling structure and a reduction gear arranged in the force transmission path between the electric motor and the first coupling structure to form an opener module which is able to be preassembled as a structural unit, wherein the opener module can be mounted on a superordinate component of the domestic appliance (for example the appliance main body).

Some embodiments comprise a control unit which controls the drive unit and which is adapted to control the drive unit such that, on transfer of the door opener from the second opener state into the first opener state while maintaining the coupling engagement between the first and second coupling structures, the first coupling structure is driven according to a movement profile which comprises an at least one-time temporary movement stop or/and an at least one-time temporary reversal of the movement direction after the second opener state has been left and before the first opener state is reached. The location of the movement stop or/and the location of the reversal of the movement direction along the drive path of the first coupling structure can be predefined. Alternatively or in addition, the control unit can be adapted, during the transfer of the door opener from the second opener state into the first opener state, to perform a monitoring function for the door opener and to effect a temporary movement stop or/and a temporary reversal of the movement direction of the first coupling structure depending on the detection by the monitoring function of the fulfilment of a given condition. For example, in the case where the drive unit comprises an electric drive motor, the monitoring function can comprise monitoring of the power consumption of the drive motor.

The aspect of the resilient mounting of a push-absorbing contact structure, which is intended and configured for push-transmitting cooperation with a movably driven push-transmitting body of a door opener that is separate from a door latch, is moreover regarded as being independently patentable, that is to say independently of the presence of two coupling structures which are configured not only for push transmission but also for pull transmission. Accordingly, according to a further aspect the invention provides a domestic electrical appliance which comprises: an appliance main body having an access opening to a usable chamber formed inside the appliance main body; a door which is movably mounted on the appliance main body and which in an open position frees the access opening and in a closed position closes the access opening; a door latch for holding the door closed in the closed position; and a door opener, structurally separate from the door latch, for opening the closed door, wherein the door opener comprises on one of the appliance main body and the door a displaceably arranged push-transmitting body and an electrically controllable drive unit for driving the push-transmitting body, wherein the door opener has on the other of the appliance main body and the door a contact structure for push-transmitting cooperation with the push-transmitting body, wherein the contact structure is resiliently mounted on the other of the appliance main body and the door.

The aspect of the articulation or bending flexibility of at least one of the two coupling structures is also considered to be independently patentable. The invention therefore also provides a domestic electrical appliance which comprises: an appliance main body having an access opening to a usable chamber formed inside the appliance main body; a door which is mounted on the appliance main body so as to be pivotable about a pivot axis and which in an open position frees the access opening and in a closed position closes the access opening; a door latch for holding the door closed in the closed position; and a door opener, structurally separate from the door latch, for opening the closed door. The door opener comprises on one of the appliance main body and the door a displaceably arranged push-transmitting body and an electrically controllable drive unit for driving the push-transmitting body. The door opener further comprises on the other of the appliance main body and the door a contact structure for push-transmitting cooperation with the push-transmitting body. The push-transmitting body or/and the contact structure provide articulation or bending flexibility in a pivot plane orthogonal to the pivot axis.

According to a further aspect, the invention provides a domestic electrical appliance comprising: an appliance main body having an access opening to a usable chamber formed inside the appliance main body; a door which is movably mounted on the appliance main body and which in an open position frees the access opening and in a closed position closes the access opening; a door opener for opening the closed door, wherein the door opener comprises an opener component displaceably arranged on one of the appliance main body and the door, and an electrically controllable drive unit for driving the opener component, wherein the door opener, starting from a first opener state in which the door is in the closed position, is able to be transferred, by driving of the opener component, into a second opener state in which the door is slightly open, and, after being transferred into the second opener state, is able to be transferred back into the first opener state by driving of the opener component again, wherein the drive unit is controlled such that, on transfer of the door opener from the second opener state into the first opener state, the opener component is able to be driven according to a movement profile which comprises an at least one-time temporary movement stop or/and an at least one-time temporary reversal of the movement direction after the second opener state has been left and before the first opener state is reached.

The temporary movement stop or/and the temporary reversal of the movement direction of the opener component can help to avoid finger injuries if, at the start of closing of the door (i.e. transfer of the door opener from the second opener state into the first opener state), a user or a child still has a finger in the gap which is formed in the first opener state between the door and the appliance main body. The movement stop, or the reversal of the movement direction, can give the user or the child the necessary time to pull the finger out of the gap. In some embodiments, the opener component is formed by the mentioned first coupling structure. This aspect of the invention is, however, alternatively also usable in those embodiments in which the door opener does not have two coupling structures which are able to be brought into releasable, bidirectionally force-transmitting engagement with one another.

For example, the opener component can lie in the force transmission path of a door latch which serves to hold the door closed and comprises two closing structures which, on closing of the door, come into mutual closing engagement, one of which closing structures is arranged on the door and the other of which is arranged on the appliance main body. Such closing structures can be formed, for example, by a closing shackle and a rotating gripper which, on closing of the door, captures the closing shackle in a gripping mouth delimited by two jaws, as shown and described, for example, in DE 198 37 248 A1. For example, the opener component can form one of the closing structures or be coupled therewith for movement, so that, by driving of the opener component, the door can be opened slightly without the force-based connection via the door latch being released. The closing structures of the door latch can thus remain unchanged in mutual closing engagement when the opener component is driven for the purposes of transferring the door opener into the second opener state. In such embodiments, the opener component is accordingly not necessarily a component that is structurally separate from the door latch; instead, the opener component and one of the closing structures can be formed by one and the same component. In its broadest interpretation, the expression door opener therefore refers within the scope of the present disclosure primarily to a function of the domestic appliance that is separate from the latching function of a door latch, not necessarily a mechanically independent assembly that is structurally completely separate from such a door latch.

The invention is usable not only but especially in domestic electrical appliances that have a door arranged on a front side of the appliance, as is generally the case with washing machines of the front-loader type or with tumble dryers, but also with dishwashers. The term door is to be interpreted broadly within the scope of the present disclosure and is to include any covering elements which allow an access opening to a usable chamber provided inside the domestic appliance to be closed as required. Accordingly the term door of the present disclosure is to cover not only doors on the front side, which are mounted on the appliance main body so as to be pivotable about a vertical pivot axis, but, for example, also covers or flaps which are mounted on the appliance main body so as to be pivotable about a horizontal pivot axis, as is the case, for example, with top-loader washing machines or conventional with domestic dishwashers.

Figure 2B:
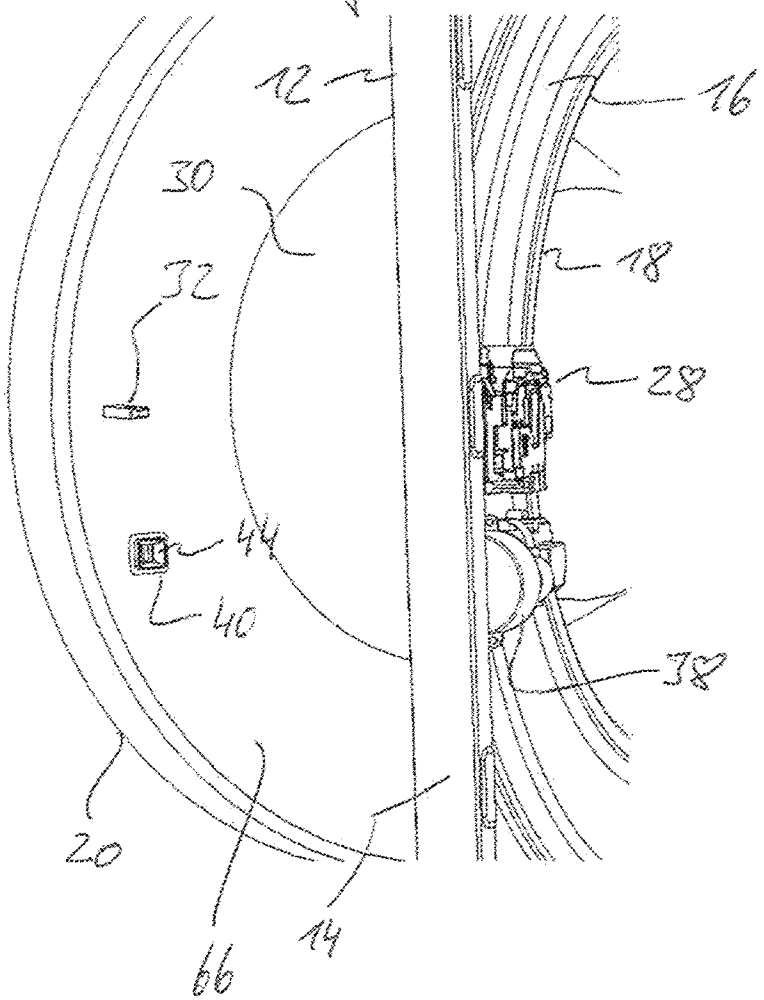
Figure 2A:
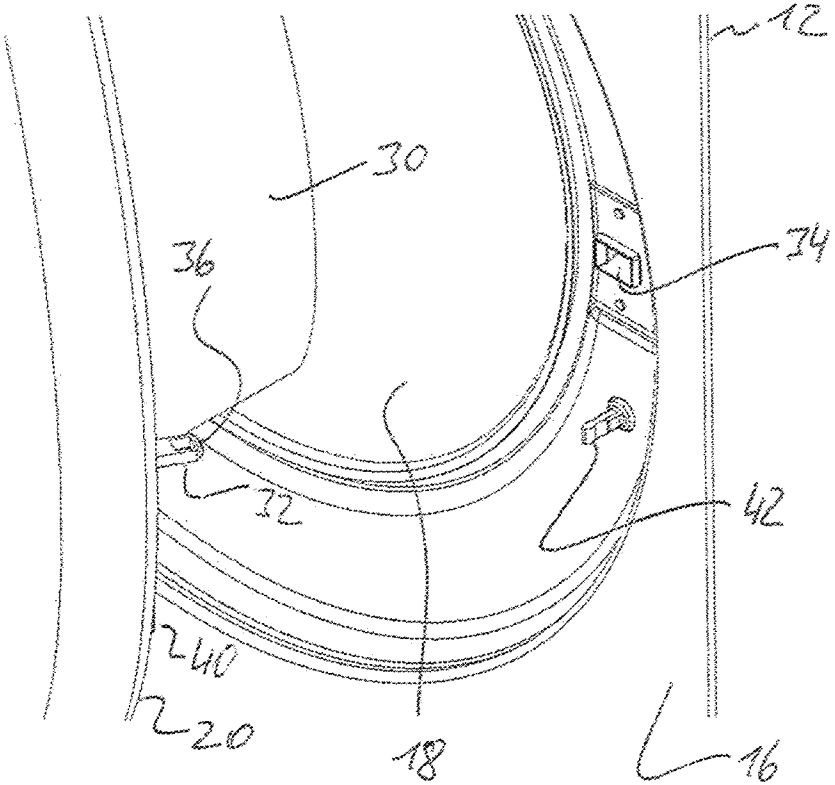
Figure 3A:
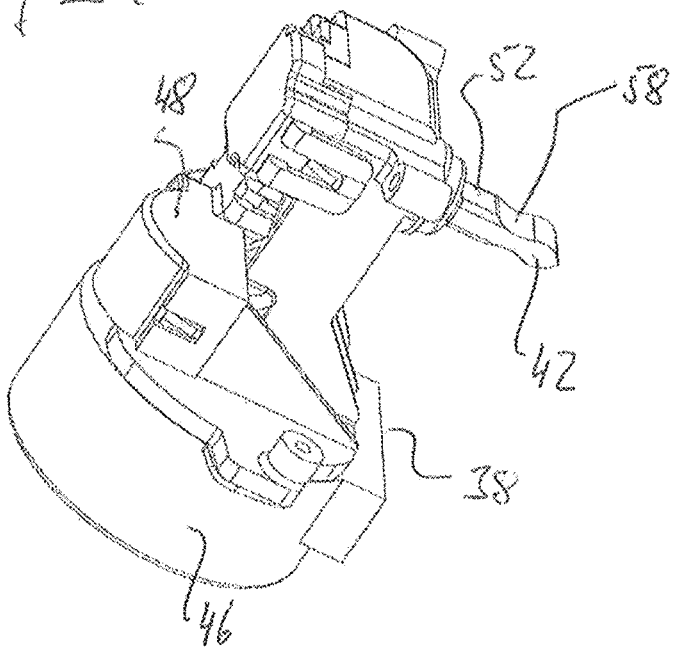
Figure 3B:
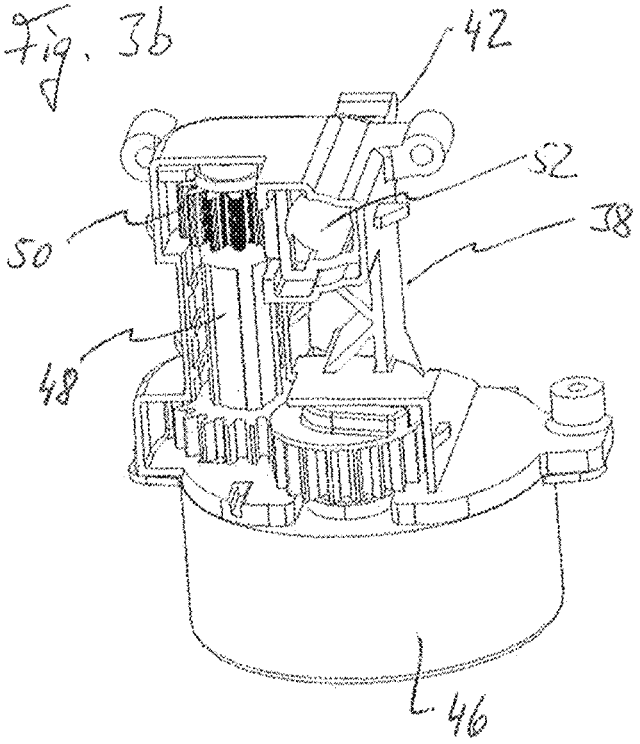
Figure 4A:
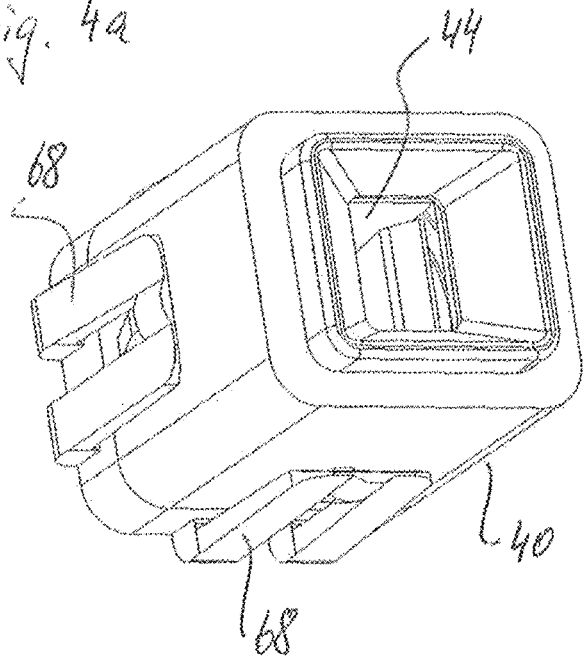
Figure 4B:
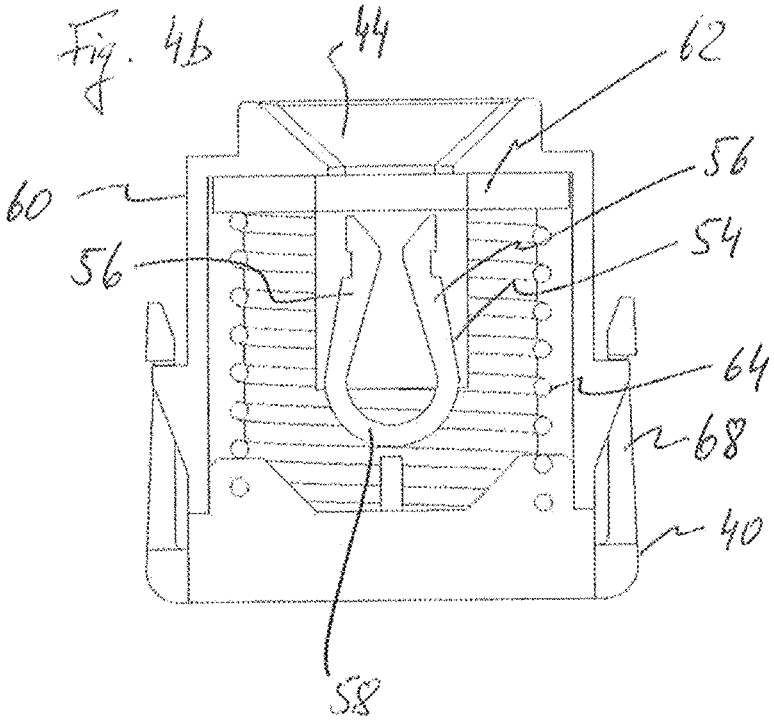
Figure 5:
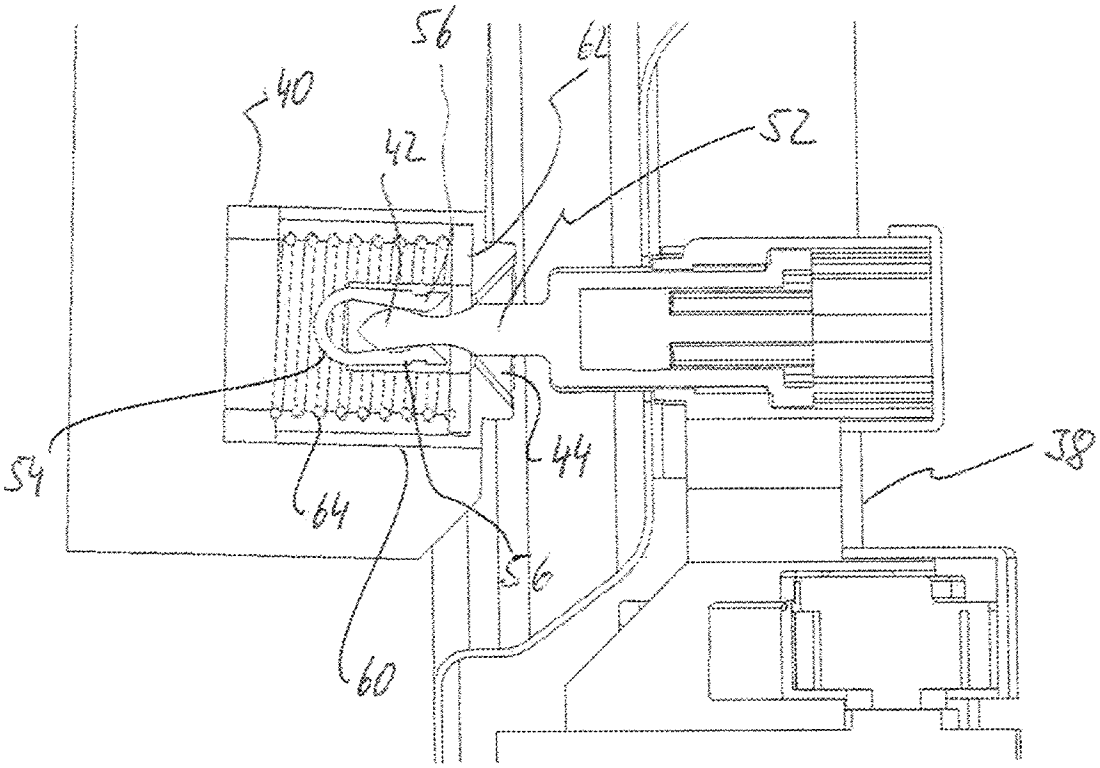
Figure 6A:
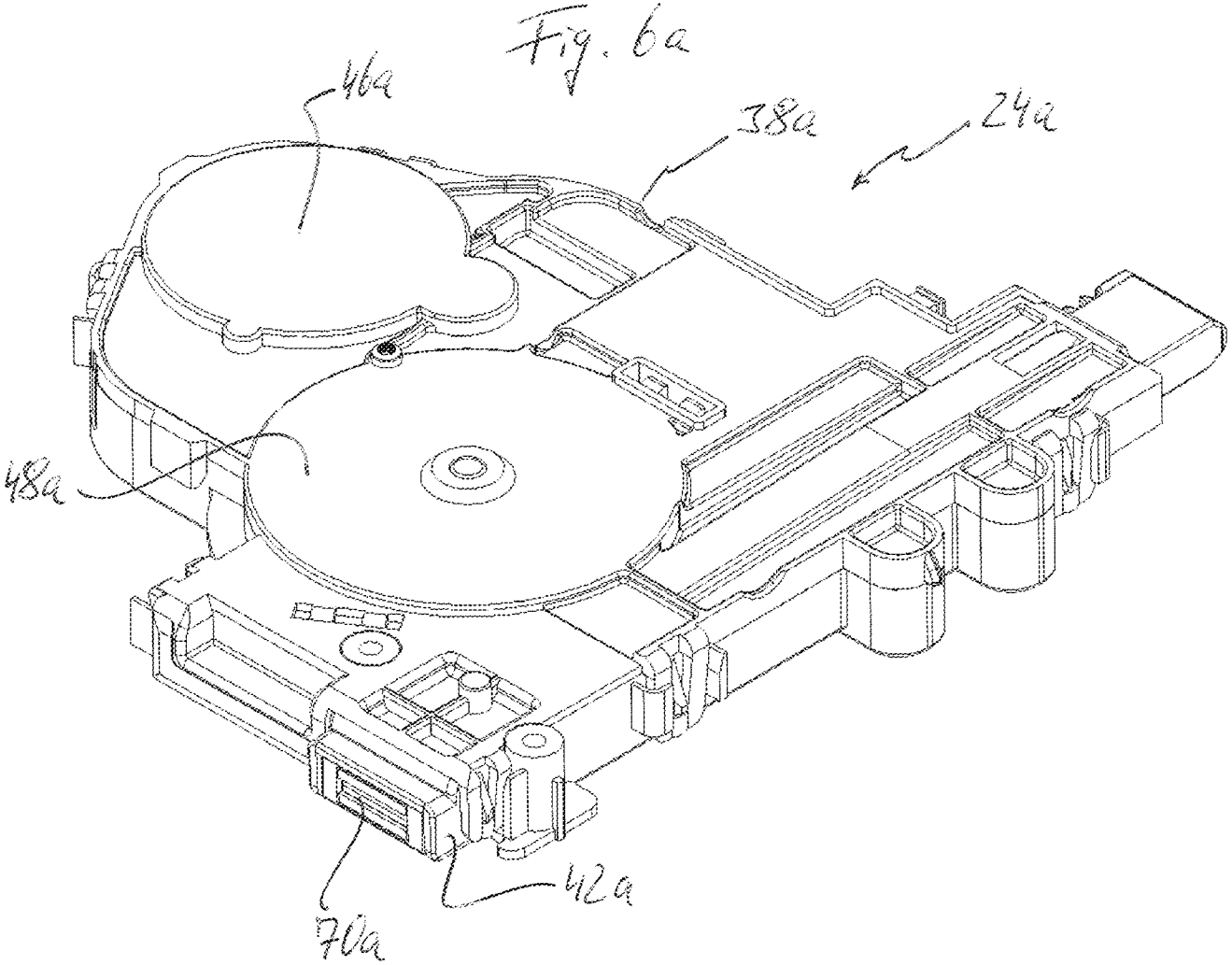
Figure 6B:
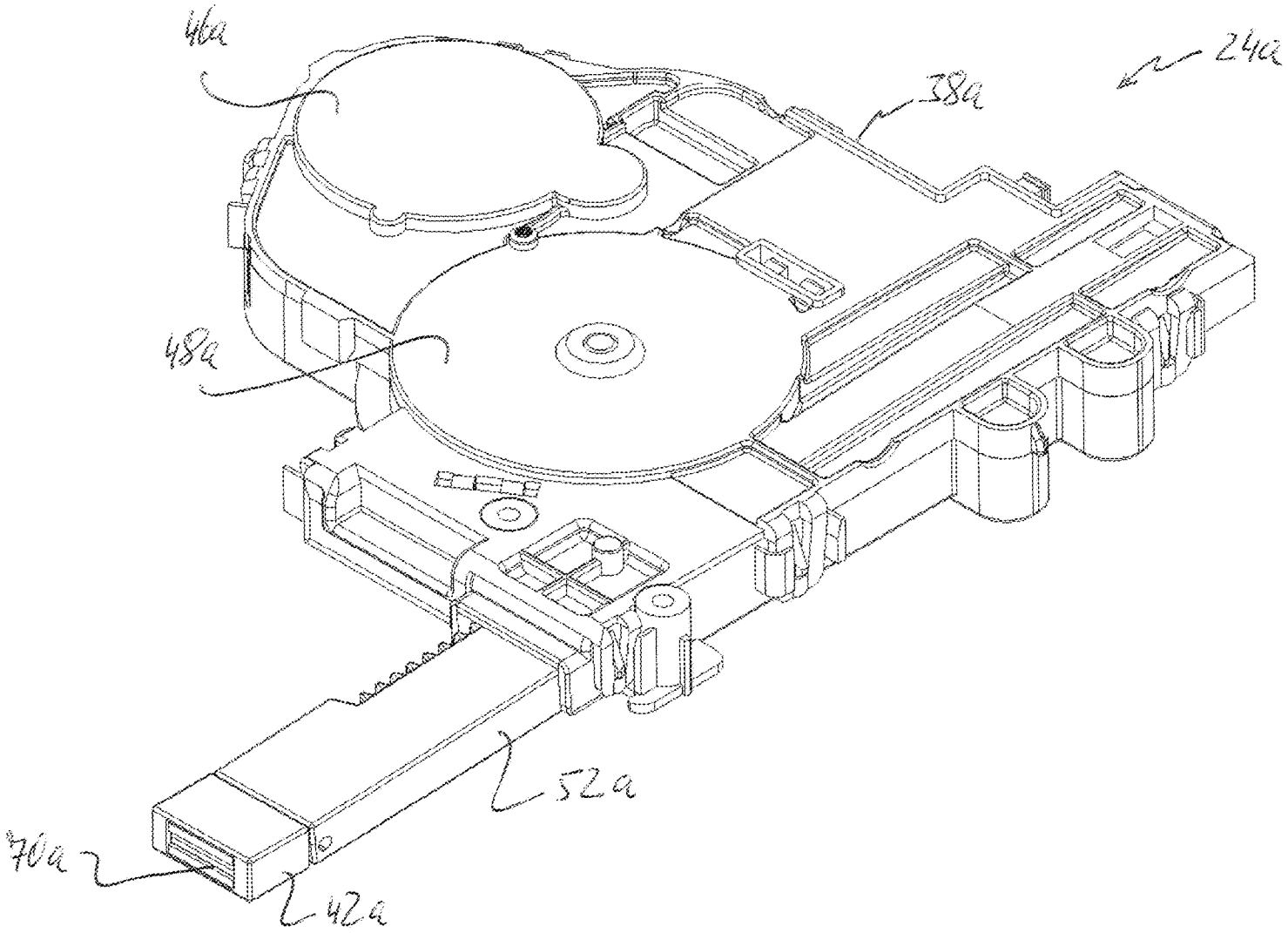
Figure 7:
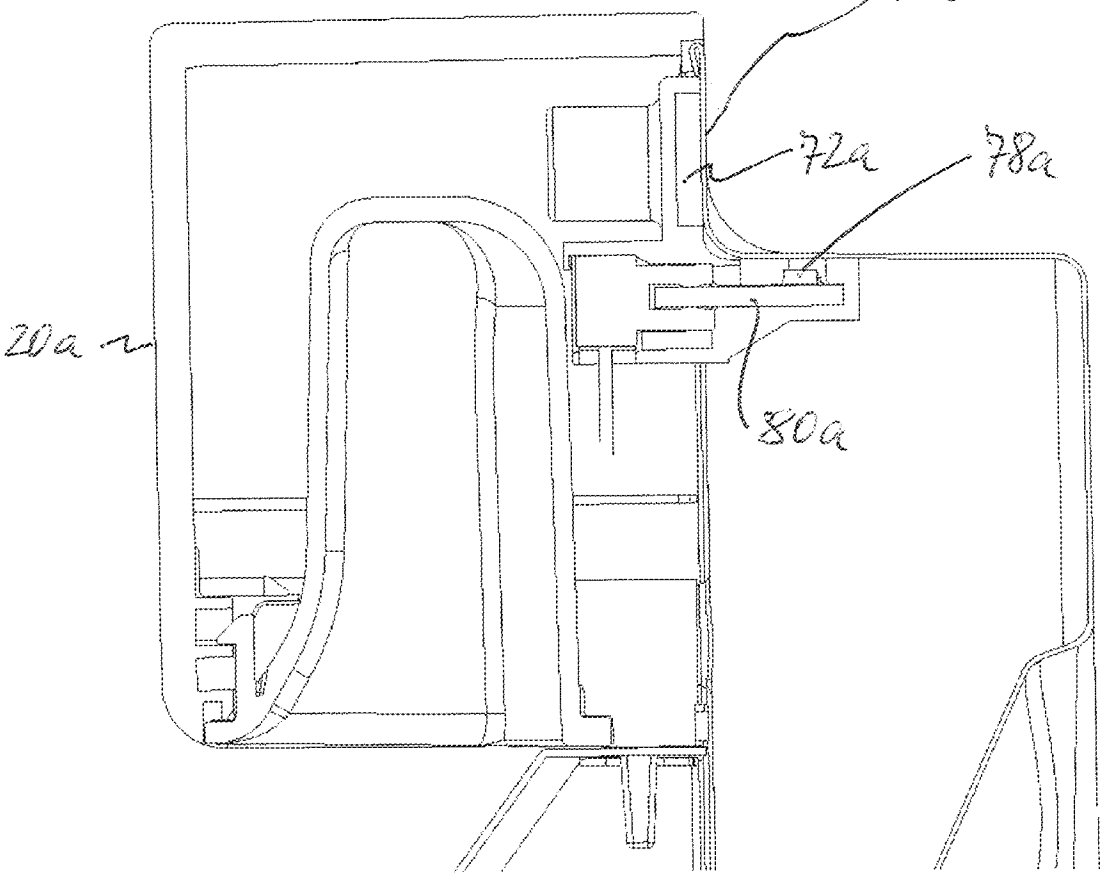
Figure 8:
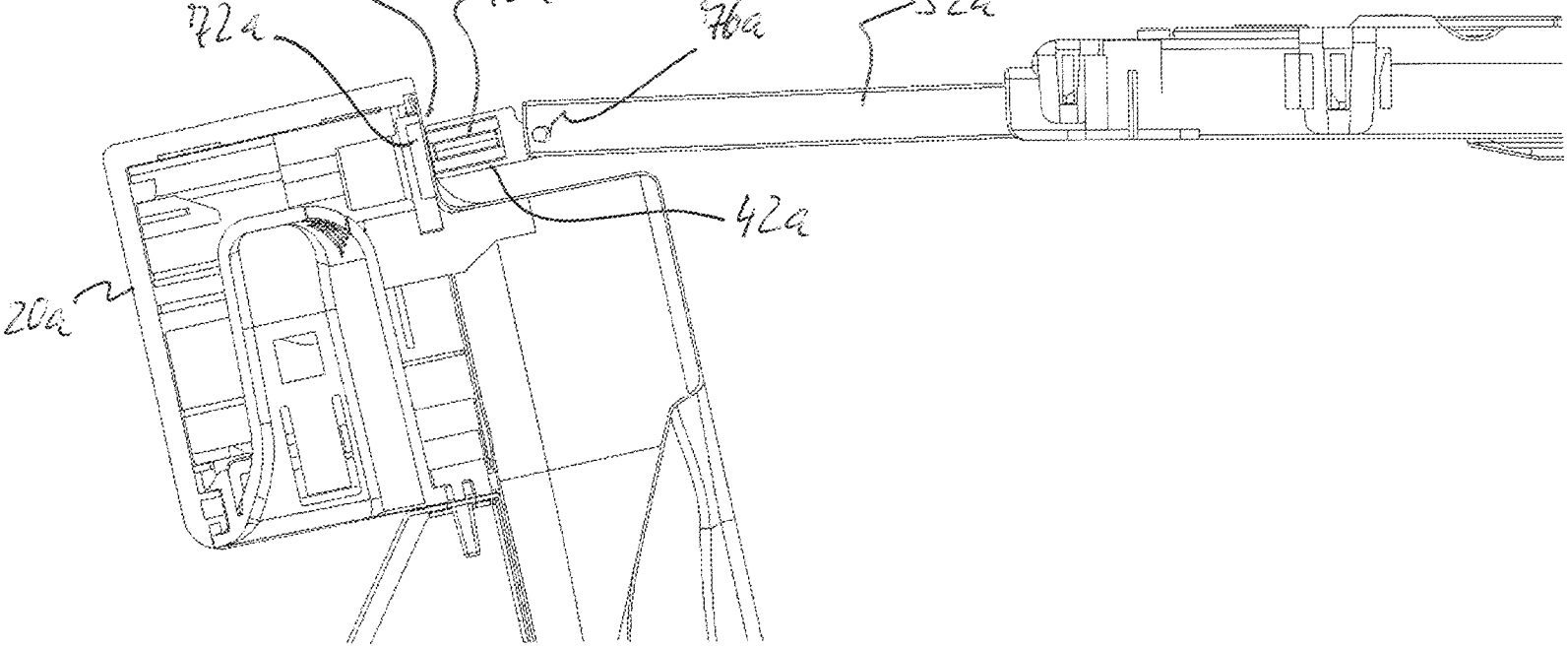

The invention will be explained further hereinbelow with reference to the accompanying drawings, in which:

FIG. 1 shows, schematically, a domestic washing machine of the front-loader type, FIG. 2*a* is a view laterally from the front of the front side of a front-loader washing machine according to an exemplary embodiment with the machine door half open, FIG. 2*b* shows the washing machine of FIG. 2*a*, again with the machine door half open, looking laterally from the rear, wherein a lateral casing of a machine body of the washing machine has been omitted, FIG. 3*a* is a perspective view of a motor-driven opener module of the washing machine of FIGS. 2*a*, 2*b*, according to an exemplary embodiment, FIG. 3*b* shows the opener module of FIG. 3*a* in another perspective view, wherein a gear housing of a reduction gear of the opener module has been omitted in part, FIG. 4*a* is a perspective view of a coupling unit of the washing machine of FIGS. 2*a*, 2*b* which cooperates with the opener module of FIGS. 3*a*, 3*b*, according to an exemplary embodiment, FIG. 4*b* is a section through the coupling unit of FIG. 4*a*, FIG. 5 is a sectional view which shows the cooperation of the opener module of FIGS. 3*a*, 3*b* with the coupling unit of FIGS. 4*a*, 4*b*, in order to position the door of the washing machine of FIGS. 2*a*, 2*b* in a slightly open position, FIG. 6*a* shows, in perspective, an opener module according to a further exemplary embodiment in a retracted state of a coupling head of the opener module, FIG. 6*b* shows the opener module of FIG. 6*a* in an advanced state of the coupling head, FIG. 7 shows a detail of a door of a dishwasher having a coupling unit, fitted into the door, for cooperation with the opener module of FIGS. 6*a*, 6*b*, according to an exemplary embodiment, FIG. 8 shows the coupling engagement between the coupling head of the opener module of FIGS. 6*a*, 6*b* and the coupling unit of FIG. 7 in a slightly open position of the door.

Reference will first be made to FIG. 1. The washing machine, designated generally 10, shown therein in highly schematic form has a machine body (appliance main body) 12 in which there is formed a washing chamber, not shown in greater detail in FIG. 1, for receiving laundry to be cleaned. The washing chamber can be formed in a manner known per se in a washing drum which is rotatably accommodated in a liquor container which is accommodated in the interior of a body housing 14 which forms the visible outside surface of the machine body 12. In a front wall 16 of the machine body 12 there is formed an access opening 18 to the washing chamber. A door 20, which is typically in the form of a bullseye door, is mounted on the machine body 12 so as to be pivotable about a vertical pivot axis and allows the access opening 18 to be closed. The access opening 18 is only adumbrated by a broken line in FIG. 1, since it is concealed by the door 20, which is shown as being closed. Although not shown in greater detail in FIG. 1, it is conventional in washing machines of the type shown in FIG. 1 that a bead-like door seal is mounted on the front wall 16 around the access opening 18, which seal is compressed on closing of the door 20 and thereby seals the washing chamber with respect to the outside against the leakage of water when the door 20 is closed.

In order to hold the door 20 closed after it has been brought into a closed position in which the access opening 18 is closed, the washing machine 10 is equipped with a door latch 22. The door latch 22 is of the pull latch type, for example, which allows a user to open the closed door 20 simply by pulling on the door. In some embodiments, the user must thereby pull on the door 20 with a force that is sufficiently great to overcome a holding-closed force of the door latch 22. The holding-closed force of the door latch 22 is based, for example, on at least one closing spring (not shown in greater detail), which relaxes on closing of the door 20 and must be tensioned (to a greater extent) again in order to open the door latch 22. The relaxing of the closing spring on closing of the door 20 has an effect of pulling the door 20 shut, by means of which the door 20 is pulled more closely towards the machine body 12 against the resistance of the mentioned door seal. Such pull latches are also referred to as push-pull latches.

Structurally separate from the door latch 22, the washing machine 10 comprises an electrically controlled door opener 24, which provides a function for automatic opening of the door 20. Automatic here means that the user does not himself have to pull or push the door 20 with his own hand. Activation of the door opener 24 can take place under the control of a program; it is also conceivable that the user can activate the door opener 24 as required by pushing an operating button. The door opener 24 is formed of components which are separate from the components of the door latch 22. In FIG. 1, the door latch 22 and the door opener 24 are shown in close proximity to one another, wherein they are arranged substantially diametrically opposite a hinge point at which there is located a pivot hinge (not shown in greater detail) of the door 20, by means of which the door 20 is mounted on the machine body 12. Such an arrangement pattern of the door latch 22 and of the door opener 24 is of course purely by way of example and is not limiting. An example of an alternative position for the door opener 24 is shown in FIG. 1 at 24', in which position the door opener is arranged angularly offset with respect to the door latch 22 by approximately a quarter circle.

The door opener 24 is electrically controlled by a control unit, shown at 26, of the washing machine 10. For example, at the end of an operating run of the washing machine 10, the control unit 26 controls the door opener 24, under the control of a program, to open the door 20 slightly in order that moisture or hot steam can escape from the washing chamber and the laundry in the washing chamber does not become musty. The size of the gap by which the door opener 24 opens the door 20 is defined and specified by the programming of the control unit 26. The door opener 24 can establish its own bidirectional force-based connection, which is independent of the door latch 22, between the door 20 and the machine body 12. It not only allows the door 20 to be opened, starting from its closed position, to a defined slightly open position, but also allows the door 20 actively to be returned from the slightly open position into the closed position without the user having to push against the door for that purpose. The door opener 24 is thus capable of closing the door 20 again automatically, after it has previously opened the door 20 and brought it into the slightly open position. In the slightly open position, the force-based connection between the door 20 and the machine body 12 via the door latch 22 is separated; in other words, the door latch 22 is open. On opening of the door 20, the door opener 24 must overcome a certain holding force (holding-closed force) of the door latch 22, which attempts to hold the door 20 closed. Also when the door 20 is subsequently pulled shut from the slightly open position, the door opener 24 must overcome a certain resistance (closing resistance) which the door latch 22 opposes to an attempt to close the door 20. On closing of the door 20 effected by means of the door opener 24, the door latch 22 is closed again and the force-based connection between the door 20 and the machine body 12 via the door latch 22 is re-established.

FIGS. 2*a* to 5 show a first concrete exemplary embodiment, wherein the same reference numerals as in FIG. 1 have been used for identical components. Unless indicated otherwise hereinbelow, reference is made to the above remarks relating to FIG. 1.

Reference will first be made to FIGS. 2*a* and 2*b*. The door latch 22 of FIG. 1 is composed, in the exemplary embodiment shown in FIGS. 2*a*, 2*b*, of a latch assembly 28 mounted on the machine body 12 and a closing stirrup 32 which is arranged on the rear side of the door 20 facing the body, laterally outside a bullseye window 30. The latch assembly 28 forms an entry mouth 34 which the closing stirrup 32 enters on closing of the door 20. The closing stirrup 32 has a stirrup web 36 which, on closing of the door 20, is gripped by a gripper, not shown in greater detail here, contained in the latch assembly 28. For example, the door latch formed by the latch assembly 28 and the closing stirrup 32 can be configured as is shown and described in DE 198 37 248 A1. The content of this DE specification is incorporated herein by reference in its entirety.

The door opener 24 of FIG. 1 is composed in the exemplary embodiment shown in FIGS. 2*a*, 2*b* of an opener module 38 mounted on the machine body 12 and a coupling unit 40 mounted on the door 20. The opener module 38 comprises a coupling head 42 which forms a first coupling structure, or an opener component, within the meaning of the present disclosure and which is movable forwards and backwards in a linear direction, wherein in the example shown the direction of movement of the coupling head 42 is substantially perpendicular to the wall plane of the front wall 16. The coupling unit 40 is configured to enter into coupling engagement with the coupling head 42 such that pushing forces and pulling forces can be transmitted between the coupling head 42 and the coupling unit 40. The possibility of bidirectional force transmission between the coupling head 42 and the coupling unit 40 makes it possible for the door opener 24 not only to open the door 20 but also to pull it shut again. The coupling head 42 can therefore also be referred to as a push-transmitting body with a pull-transmitting function.

The coupling engagement between the coupling head 42 and the coupling unit 40 is established in that the coupling head 42 enters an entry opening 44 of the coupling unit 40 and comes into engagement with a coupling clasp which is contained in the coupling unit 40 and will be described in greater detail hereinbelow. The displaceability of the coupling head 42 comprises to and fro movability at least between a first head position and a second head position. The first head position corresponds, provided that coupling engagement between the coupling head 42 and the coupling unit 40 has been established, to the closed position of the door 20 (first opener state). The second head position corresponds, again provided that the coupling head 42 and the coupling unit 40 are in coupling engagement, to the mentioned slightly open position of the door 20 (second opener state). In each of the first and second head position, the coupling engagement between the coupling head 42 and the coupling unit 40 can be released by the user at any time if the user pulls on the door 20 in the opening direction. The coupling head 42 thereby slides out of the clasp of the mentioned coupling clasp. For releasing the coupling engagement, the user must overcome a certain holding force (coupling holding force) of the door opener 24; this coupling holding force is based on a spring action of the coupling clasp. Conversely, in each of the first and second head position, coupling engagement between the coupling head 42 and the coupling unit 40 can be established by the user at any time if the user moves the door 20 in the closing direction until the coupling head 42 slides into the coupling unit 40 and is clasped by the coupling clasp. For coupling the coupling head 42 with the coupling unit 40, a certain resistance (coupling resistance) is to be overcome by the user; the coupling resistance is also based on the spring action of the mentioned coupling clasp.

The second head position is a position in which the coupling head 42—from the point of view of a user standing in front of the washing machine 10—is advanced further forwards than in the first head position. In some embodiments, the coupling head 42 can protrude from the front wall 16 of the machine body 12 at least in the second head position and in some circumstances also in the first head position, as is shown in FIG. 2*a*. In some embodiments, the coupling head 42 can be retracted further beyond the first head position into a third head position, in which it is possible to close the door 20 fully without the coupling head 42 at the same time entering into coupling engagement with the coupling unit 40. In such embodiments, the signal of an electric door switch (which serves as a detection means for recognising the closed state of the door 20) contained in the door latch 22 can cause the control unit 26 to activate the door opener 24 in order to move the coupling head 42 forwards out of the third head position into the first head position. In such embodiments, if the user wishes to close the door 20 he has to overcome only the closing resistance of the door latch 22 but not the coupling resistance of the door opener 24.

The opener module 38 is shown in FIGS. 3*a*, 3*b*. It comprises an electric motor 46 serving as a drive unit, a reduction gear 48 and the coupling head 42, which is formed at a rod end of a rod body 52 that meshes with a drive pinion 50 of the reduction gear 48. The opener module 38 is a component which is able to be preassembled and is able to be fastened as such to the machine body 12.

Reference will now additionally be made to FIGS. 4*a*, 4*b* and 5. The coupling unit 40 comprises a coupling clasp 54 which forms a second coupling structure within the meaning of the present disclosure and in the example shown forms two clasp arms (spring legs) 56 which are resiliently deflectable away from one another and are connected together via a web region 58. The coupling clasp 54 is a one-piece component which can be produced from a metal material or alternatively from a plastics material. On establishment of coupling engagement, the coupling head 42 is urged between the free ends of the clasp arms 56 and pushes them apart against a restoring spring force generated by the coupling clasp 54, until finally the coupling head 42 has slipped so far into the coupling clasp 54 that the clasp arms 56 engage around the coupling head 42 on both sides and with their free arm ends engage with a snap action into a neck region 58 (FIG. 3*a*) of tapered cross section, formed behind the coupling head 42, of the rod body 52. FIG. 5 shows the situation of coupling engagement between the coupling head 42 and the coupling clasp 54. The door 20 is thereby in the slightly open position.

The coupling unit 40 has a clasp housing 60 which forms the entry opening 44 and in which there is movably accommodated a clasp carrier 62, which in the example shown is cup-like. The clasp carrier 62 is biased into an end position by a spring element 64, here a helical compression spring, which is likewise accommodated in the clasp housing 60. From this end position, the clasp carrier 62 is able to be displaced, against the action of the spring element 64, into a displaced position situated deeper in the clasp housing 60. The coupling clasp 54, which forms a contact structure for the coupling head 42 within the meaning of the present disclosure, is in turn held on the clasp carrier 62; for example, it is for this purpose inserted with its clasp arms 56 through a base piece of the clasp carrier 62. Owing to the resilient mounting of the clasp carrier 62, the coupling clasp 54 is able to be displaced backwards in a resilient manner if, for example, the user attempts to slam the door 20 shut with great force. This reduces impacts on the reduction gear 48 and the electric motor 46 of the opener module 38. The clasp housing 60 is formed with suitable mounting structures which allow the coupling unit 40 to be fastened, in particular without screws, to a frame 66 of the door 20 which extends around the bullseye window 30 (FIG. 2*b*). In the example shown, these mounting structures comprise a plurality of snap-in tongues 68 (FIG. 4*a*) for the insertion of the coupling unit 40 with a snap action into a seat, not shown in greater detail, formed in the frame 66, for the coupling unit 40.

The configuration of the coupling engagement in which the clasp arms 56 engage around the coupling head 42 on both sides and project into the neck region 58 not only allows the door 20 to be pushed open by means of the coupling head 42, but also allows the door 20 subsequently to be pulled shut again. The spring force of the coupling clasp 54 is sufficiently strong that, when the door 20 is pulled shut, the closing resistance of the door latch 22 and also the compression resistance of the door seal can be overcome without the coupling head 42 slipping out from between the clasp arms 56 and losing coupling engagement with the coupling clasp 54.

It must be expected that, in the slightly open position of the door 20, a user or a child who is playing will intentionally or accidentally put a finger or their whole hand into the gap between the door 20 and the machine body 12. If the control unit 26 activates the door opener 24 in this situation in order to close the door 20 again, without the user or child noticing, painful hand injuries may result. Therefore, the control unit 26 can be so programmed that the return of the coupling head 42 from the relatively advanced second head position into the relatively retracted first head position on closing of the door 20 does not take place in a single, continuous movement stroke in the same movement direction, but the coupling head 42 inserts at least once a temporary movement stop or/and performs at least once a temporary reversal of the movement direction, before the coupling head 42 reaches the first head position.

For example, the coupling head 42—without changing the movement direction—can insert a brief stop one or more times at positions in which the gap that remains between the door 20 and the machine body 12 is still sufficiently large to avoid finger injuries but it is ensured that the user or the child is startled and quickly pulls his hand out of the gap.

The stop position(s) can be predefined and always stopped at on closing of the door 20, regardless of whether there is an object (e.g. finger) in the gap or not. Alternatively, it is conceivable that the control unit 26 monitors the power consumption of the electric motor 46 on closing of the door 20. An increase in the power consumption can indicate the presence of an object in the gap, which prevents the door 20 from closing completely. As soon as the control unit 26 detects a significant increase in the power consumption, it can temporarily stop the movement of the coupling head 42 from the second head position in the direction towards the first head position in order to give the opportunity for the obstruction to be removed.

Alternatively or in addition to a temporary movement stop, the control unit 26 can effect a temporary reversal of the movement direction of the coupling head 42 on closing of the door 20, either by default or under the condition that an obstruction situation is detected, for example on the basis of the power consumption of the electric motor 46. For example, a possible movement pattern can be such that the closing process begins with a movement of the coupling head 42 in the closing direction, whereby, however, after a portion of the movement distance until the first head position is reached, the coupling head 42 reverses (optionally accompanied by a short movement stop) and moves a short distance back in the direction towards the second head position again or even as far as the second head position. This is to give the opportunity for the fingers to be pulled out of the gap between the door 20 and the machine body 12. The coupling head 42 then moves in the closing direction again, whereby it either moves to the first head position directly or, before doing so, again performs a temporary movement stop at the same or a different stop position or/and a temporary reversal of the movement direction at the same or a different reversal position.

The exemplary embodiment of FIGS. 6*a*, 6*b*, 7 and 8 relates, as a further concrete exemplary embodiment, to a door opener for automatically opening the door of a domestic dishwasher. Components which are the same or have the same effect are thereby provided with the same reference numerals as in the preceding figures, but with the addition of a lowercase letter. Reference is again made to the preceding remarks, unless indicated otherwise hereinbelow.

The opener module 38*a*, shown in perspective in FIGS. 6*a*, 6*b*, of the door opener 24*a* is configured for magnetic coupling with the coupling unit 40*a* arranged on the door 20*a*. To this end, the coupling head 42*a* of the opener module 38*a* is equipped with a permanent magnet 70*a* which is able to enter into magnetic force-based connection with a metal body 72, manufactured, for example, from iron material, of the coupling unit 40*a*. The magnetic force-based connection allows pulling forces to be transmitted between the coupling head 42*a* and the coupling unit 40*a*, so that, starting from the situation according to FIG. 8, the door 20*a* can be pulled from the slightly open position according to FIG. 8 into the fully closed position (closed position) by pulling the coupling head 42*a* back into the opener module 38*a*. The magnetic force-based connection between the permanent magnet 70*a* and the metal body 72*a* is thereby sufficiently strong to compress a door seal (not shown in greater detail) which acts between the door 20*a* and a dishwashing container (likewise not shown) of the dishwasher and, when the door 20*a* is closed, seals a dishwashing chamber formed in the dishwashing container with respect to the outside. The magnetic force-based connection is additionally sufficiently strong to overcome, when the door 20*a* is pulled shut, a closing resistance which is exerted by a closing spring arrangement of a door latch (not shown in greater detail) which is structurally separate from the door opener 24*a*.

The door 20*a* is—as is conventional in domestic dishwashers—mounted on the mentioned dishwashing container so as to be pivotable about a pivot axis 74*a* shown schematically in FIG. 8. The pivot axis 74*a* generally extends horizontally and is located in a region of the dishwashing container close to the floor, so that the door 20*a* can be pivoted downwards from a substantially vertical position, in which the door 20*a* is closed, in the forwards direction (from the point of view of a user standing in front of the dishwasher) into a substantially horizontal position in which the user has the greatest possible access to the dishwashing chamber. Owing to this pivotable mounting of the door 20*a*, the coupling unit 40*a* moves with the metal body 72*a* along a circular path on opening and closing of the door 20*a*. In order not to impair the quality of the magnetic force-based connection between the permanent magnet 70*a* and the metal body 72*a*, the coupling head 42*a* in the example shown is pivotably held on the rod body 52*a* via a pivot hinge 76*a*. The coupling head 42*a* is thus able to perform pivoting movements relative to the rod body 52*a* in the pivot plane of the door 20*a* and thereby follow the curved path of the coupling unit 40*a*.

It will be appreciated that, in a modified embodiment, the coupling unit 40*a* can contain the permanent magnet 70*a* and the metal body 72*a* can be contained in the coupling head 42*a*.

FIG. 6*a* shows the coupling head 42*a* in its first (retracted) head position. The coupling head 42*a* occupies this position when the door 20*a* is in its closed position. In this situation there can already be mechanical stop contact between the coupling head 42*a* and the coupling unit 40*a*. Alternatively, it can be that, when the door 20*a* is closed and the coupling head 42*a* is in the first head position, there is still no physical contact between the coupling head 42*a* and the coupling unit 40*a*. In the latter case, such physical contact, which allows pushing forces to be transmitted from the coupling head 42*a* to the door 20*a* and thus allows the door to be opened, is established only when the coupling head 42*a* is moved forwards out of the first head position according to FIG. 6*a* in the direction towards the second head position according to FIG. 6*b*.

The door opener 24*a* additionally includes a sensor 78*a* which is suitably configured and positioned to recognise whether, with the coupling head 42*a* deployed (that is to say in the second head position corresponding to FIG. 6*b*), the door 20*a* is still in the slightly open position according to FIG. 8 or has already been opened further by the user. If the user has already opened the door fully, the coupling head 42*a* can be moved back into the opener module 38*a*. This reduces the risk of the user bumping into the protruding coupling head 42*a* and thereby possibly injuring himself. It also reduces possible risks of damage to the opener module 38*a*. In the case of the exemplary embodiment of FIGS. 6*a* to 8, the sensor 78*a* is in the form of a Hall sensor, for example, which responds to the magnetic field of the permanent magnet 70*a* fitted into the coupling head 42*a*. The sensor 78*a* is mounted on a printed circuit board 80*a* which, as part of the coupling unit 40*a*, is fitted into the door 20*a*. From the printed circuit board 80*a*, a sensor signal generated by the sensor 78*a* is sent to a control unit (not shown in greater detail), which controls the operation of the opener module 38*a* in dependence on the sensor signal. Such a control unit can be arranged in the door 20*a* in the case of the exemplary embodiment according to FIGS. 6*a* to 8. It will be appreciated that, as an alternative, a control unit for the opener module 38*a* can be fitted in the mentioned dishwashing container.

The invention claimed is:

1. A domestic electrical appliance, comprising:

an appliance main body having an access opening to a usable chamber formed inside the appliance main body;

a door which is movably mounted on the appliance main body and which in an open position frees the access opening and in a closed position closes the access opening;

a door latch for holding the door closed in the closed position; and a door opener for opening the closed door, wherein the door opener includes a first coupling structure displaceably arranged on one of the appliance main body and the door, an electrically controllable drive unit for driving the first coupling structure, and a second coupling structure arranged on the other of the appliance main body and the door, wherein the first and second coupling structure are configured for push- and pull-transmitting, releasable coupling engagement with one another, wherein the door opener is an assembly which is structurally separate from the door latch, the door latch and the door opener establishing separate force transmission paths for the transmission of a holding-closed force of the door latch and an opening force of the door opener between the door and the appliance main body, wherein the door opener is configured to transfer, by driving of the first coupling structure, from a first opener state in which the door is in the closed position and the first coupling structure is in coupling engagement with the second coupling structure into a second opener state in which the door is slightly open and the coupling engagement between the first and second coupling structure is maintained, wherein the door opener, after being transferred from the first opener state into the second opener state, is configured to return, by driving of the first coupling structure, back into the first opener state while maintaining the coupling engagement between the first and second coupling structure, and wherein a transfer, effected by driving of the first coupling structure, of the door opener from the first into the second opener state separates a force-based connection between the appliance main body and the door via the door latch, wherein a return movement, effected by driving of the first coupling structure, of the door opener from the second into the first opener state, while maintaining the coupling engagement between the first and second coupling structure, re-establishes the force-based connection between the appliance main body and the door via the door latch.

2. The domestic appliance according to claim 1, wherein in the second opener state the coupling engagement between the first and second coupling structures is configured to be released by a user pulling on the door.

3. The domestic appliance according to claim 2, wherein in the first opener state the coupling engagement between the first and second coupling structures is configured to be released by a user pulling on the door.

4. The domestic appliance according to claim 1, comprising a sensor system for detecting a separation of the coupling engagement in the second opener state, wherein the drive unit is controlled in such a manner that, in dependence on the detection of a separation of the coupling engagement in the second opener state, the first coupling structure is moved back in the direction towards a position that the first coupling structure occupies in the first opener state.

5. The domestic appliance according to claim 1, wherein the first and the second coupling structures are able to be brought into push- and pull-transmitting coupling engagement solely by being moved towards one another, and the coupling engagement is configured to be released solely by moving the first and the second coupling structures away from one another.

6. The domestic appliance according to claim 1, wherein the first and the second coupling structures are configured to be brought into push- and pull-transmitting coupling engagement by being moved towards one another and overcoming a coupling resistance based on spring action, and the coupling engagement is configured to be released by moving the first and the second coupling structures away from one another and overcoming a coupling holding force based on spring action.

7. The domestic appliance according to claim 1, wherein one of the first and second coupling structures forms a coupling head and the other of the first and second coupling structures forms two coupling arms which are configured to be resiliently deflected away from one another out of a rest position, wherein coupling engagement is configured to be established by relative introduction of the coupling head between the coupling arms.

8. The domestic appliance according to claim 7, wherein the coupling arms are formed by the clasp legs of a spring clasp formed in one piece.

9. The domestic appliance according to claim 1, wherein the coupling engagement comprises a magnetic force-based connection between the first and the second coupling structure.

10. The domestic appliance according to claim 1, wherein the second coupling structure is resiliently mounted on the other of the appliance main body and the door.

11. The domestic appliance according to claim 1, wherein the door is mounted on the appliance main body so as to be pivotable about a pivot axis, and at least one of the first and the second coupling structure provides one of articulation and bending flexibility in a pivot plane orthogonal to the pivot axis.

12. The domestic appliance according to claim 1, comprising a control unit configured to control the drive unit, such that, on transfer of the door opener from the second opener state into the first opener state while maintaining the coupling engagement between the first and second coupling structures, the first coupling structure is driven according to a movement profile which comprises at least one of a temporary movement stop and a temporary reversal of the movement direction after the second opener state has been left and before the first opener state is reached.

13. The domestic appliance according to claim 12, wherein the location of the movement stop or/and the location of the reversal of the movement direction along the drive path of the first coupling structure are predefined.

14. The domestic appliance according to claim 12, wherein the control unit is adapted, during the transfer of the door opener from the second opener state into the first opener state, to perform a monitoring function for the door opener and to effect at least one of a temporary movement stop and a temporary reversal of the movement direction of the first coupling structure depending on the detection by the monitoring function of the fulfilment of a given condition.

15. The domestic appliance according to claim 14, wherein the drive unit comprises an electric drive motor and the monitoring function comprises monitoring the power consumption of the drive motor.

* * * * *